US011852343B2

(12) United States Patent
Akamatsu et al.

(10) Patent No.: US 11,852,343 B2
(45) Date of Patent: Dec. 26, 2023

(54) COMBUSTOR COMPONENT, COMBUSTOR INCLUDING THE COMBUSTOR COMPONENT, AND GAS TURBINE INCLUDING THE COMBUSTOR

(71) Applicant: MITSUBISHI HEAVY INDUSTRIES, LTD., Tokyo (JP)

(72) Inventors: Shinji Akamatsu, Yokohama (JP); Kenji Sato, Yokohama (JP); Naoki Abe, Yokohama (JP); Taiki Kinoshita, Yokohama (JP); Hiroki Shibata, Yokohama (JP); Norihiko Motoyama, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/774,642

(22) PCT Filed: Dec. 21, 2020

(86) PCT No.: PCT/JP2020/047619
§ 371 (c)(1),
(2) Date: May 5, 2022

(87) PCT Pub. No.: WO2021/132128
PCT Pub. Date: Jul. 1, 2021

(65) Prior Publication Data

US 2022/0373180 A1 Nov. 24, 2022

(30) Foreign Application Priority Data

Dec. 24, 2019 (JP) ..... 2019-232278

(51) Int. Cl.
*F23R 3/00* (2006.01)
*F23M 20/00* (2014.01)
(Continued)

(52) U.S. Cl.
CPC ..... *F23R 3/002* (2013.01); *F23M 20/005* (2015.01); *F01N 1/023* (2013.01);
(Continued)

(58) Field of Classification Search
CPC .. F23R 3/002; F23R 3/44; F23R 2900/00014; F23M 20/005; F01N 1/023; F05D 2260/963; F23D 2210/00
See application file for complete search history.

(56) References Cited

U.S. PATENT DOCUMENTS 7,080,514 B2 * 7/2006 Bland ..... F23M 20/005 60/725
7,334,408 B2 * 2/2008 Bethke ..... F23R 3/002 60/725
(Continued)

FOREIGN PATENT DOCUMENTS

CN 104033926 9/2014
EP 1 666 795 6/2006
(Continued)

OTHER PUBLICATIONS

Office Action dated Dec. 1, 2022 in counterpart CN Application No. 202080069304.7.
(Continued)

*Primary Examiner* — Gerald L Sung
*Assistant Examiner* — Rene D Ford
(74) *Attorney, Agent, or Firm* — Wenderoth, Lind & Ponack, L.L.P.

(57) ABSTRACT

A combustor component of a combustor for combusting fuel to produce a combustion gas includes a combustion cylinder forming a passage for the combustion gas, a first acoustic device which internally includes a first cavity communicating with the passage via a first through hole formed in the combustion cylinder, a second acoustic device which is
(Continued)

located on a radially outer side of the first acoustic device so as to cover the first acoustic device, and internally includes a second cavity communicating with the passage via a second through hole formed in the combustion cylinder, and a first communication passage causing the first cavity and an outer space of the combustion cylinder to communicate with each other without via the first through hole and the second cavity.

13 Claims, 12 Drawing Sheets

(51) Int. Cl.
*F23R 3/44* (2006.01)
*F01N 1/02* (2006.01)

(52) U.S. Cl.
CPC .... *F05D 2260/963* (2013.01); *F23D 2210/00* (2013.01); *F23R 3/44* (2013.01); *F23R 2900/00014* (2013.01)

(56) References Cited

U.S. PATENT DOCUMENTS 7,832,211 B2 * 11/2010 Ikeda ..... F23R 3/04 60/725
8,469,141 B2 * 6/2013 Wang ..... F23M 20/005 244/1 N
8,727,070 B2 * 5/2014 Huber ..... F23M 20/005 123/184.55
8,978,382 B2 * 3/2015 Huber ..... F23R 3/002 60/725
8,991,185 B2 * 3/2015 Huber ..... F23M 20/005 60/725
9,163,837 B2 * 10/2015 Sutcu ..... F23R 3/26
10,546,070 B2 * 1/2020 Hellat ..... G06F 30/00
10,712,004 B2 * 7/2020 Kugimiya ..... F23R 3/42
2011/0220433 A1 9/2011 Nakamura et al.
2011/0265484 A1 * 11/2011 Huber ..... F23M 20/005 60/755
2015/0020498 A1 1/2015 Schilp
2015/0059345 A1 * 3/2015 Hellat ..... G06F 30/00 60/725
2015/0082794 A1 * 3/2015 Schilp ..... F02K 1/827 60/722
2022/0373180 A1 * 11/2022 Akamatsu ..... G10K 11/16

FOREIGN PATENT DOCUMENTS

JP 2007-132640 5/2007
JP 2013-117231 6/2013
JP 6129420 5/2017

OTHER PUBLICATIONS

Notice of Reasons for Refusal dated Feb. 14, 2023 in corresponding Japanese Patent Application No. 2021-567426, with English language translation.
International Search Report dated Feb. 22, 2021 in International (PCT) Application No. PCT/JP2020/047619.

* cited by examiner

COMBUSTOR COMPONENT, COMBUSTOR INCLUDING THE COMBUSTOR COMPONENT, AND GAS TURBINE INCLUDING THE COMBUSTOR

TECHNICAL FIELD

The present disclosure relates to a combustor component, a combustor including the combustor component, and a gas turbine including the combustor.

BACKGROUND

Patent Documents 1 and 2 each disclose a technique of providing an acoustic device called an acoustic liner or an acoustic damper in a combustor of a gas turbine in order to reduce combustion vibration. Such acoustic device has a resonance space (cavity) communicating with a combustion region of the combustor.

CITATION LIST

Patent Literature

Patent Document 1: JP2007-132640A
Patent Document 2: JP2013-117231A

SUMMARY

Technical Problem

Among such acoustic devices, in an acoustic device having a multiple-story configuration with respect to the radial direction of the combustor (for example, a two-story structure of a first acoustic device and a second acoustic device), in order to discharge fuel which was not combusted during an operation of the gas turbine from the combustion region or to introduce purging air to the combustion region, it may be configured such that a resonance space (first cavity) of the first acoustic device communicates with an outer space of a combustion cylinder of a combustion device. In this case, there is a problem that the first acoustic device and the second acoustic device are acoustically coupled, if it is configured such that the first cavity communicates with the outer space via a resonance space (second cavity) of the second acoustic device disposed so as to cover the first acoustic device.

In view of the above, an object of at least one embodiment of the present disclosure is to provide a combustor component, which allows the first cavity of the first acoustic device and the outer space of the combustion cylinder to communicate with each other while suppressing the acoustic coupling between the first acoustic device and the second acoustic device, a combustor including the combustor component, and a gas turbine including the combustor.

Solution to Problem

In order to achieve the above object, the combustor component according to the present disclosure is a combustor component of a combustor for combusting fuel to produce a combustion gas, that includes a combustion cylinder forming a passage for the combustion gas, a first acoustic device which internally includes a first cavity communicating with the passage via a first through hole formed in the combustion cylinder, a second acoustic device which is located on a radially outer side of the first acoustic device so as to cover the first acoustic device, and internally includes a second cavity communicating with the passage via a second through hole formed in the combustion cylinder, and a first communication passage causing the first cavity and an outer space of the combustion cylinder to communicate with each other without via the first through hole and the second cavity.

Advantageous Effects

With the combustor component of the present disclosure, since the first communication passage is disposed which causes the first cavity and the outer space of the combustion cylinder to communicate with each other without via the first through hole and the second cavity, it is possible to cause the first cavity of the first acoustic device and the outer space of the combustion cylinder to communicate with each other, while suppressing acoustic coupling between the first acoustic device and the second acoustic device.

DETAILED DESCRIPTION

Hereinafter, a combustor component, a combustor including the combustor component, and a gas turbine including the combustor according to Embodiments of the present disclosure will be described with reference to the drawings. The embodiments each indicate one aspect of the present disclosure, do not intend to limit the disclosure, and can optionally be modified within a range of a technical idea of the present disclosure.

Embodiment 1

<Configuration of Gas Turbine and Combustor According to Embodiment 1 of Present Disclosure>

Figure 1:
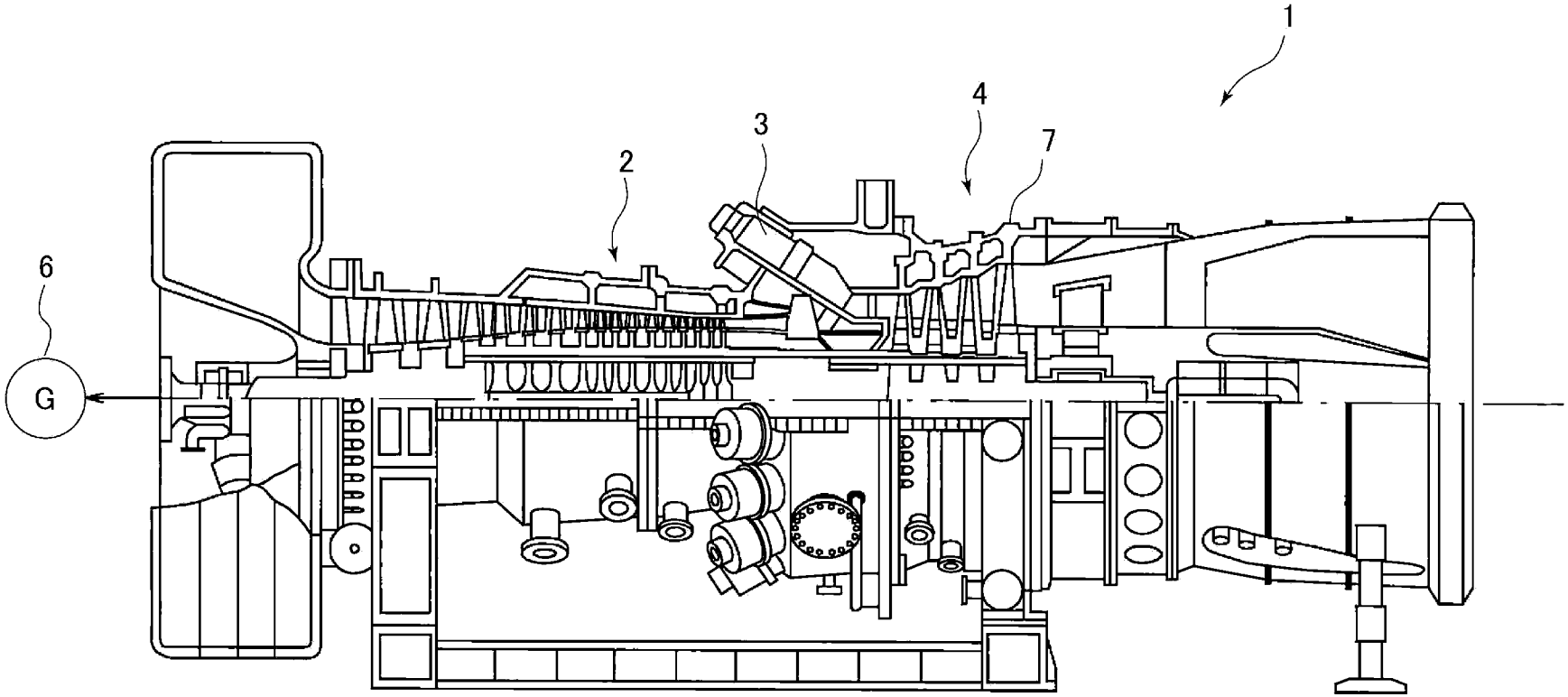
FIG. 1 is a schematic configuration view of a gas turbine according to Embodiment 1 of the present disclosure.

As shown in FIG. 1, a gas turbine 1 according to Embodiment 1 includes a compressor 2, at least one combustor 3, and a turbine 4. The compressor 2 is configured to suck in and compress atmosphere which is external air, and to supply the compressed air to each combustor 3. The combustor 3 is configured to combust fuel supplied from outside with the air compressed by the compressor 2, thereby producing a combustion gas. The turbine 4 is configured to generate a rotational driving force in response to supply of the combustion gas produced by the combustor 3, and to output the generated rotational driving force to the compressor 2 and an external device such as a generator 6.

Figure 2:
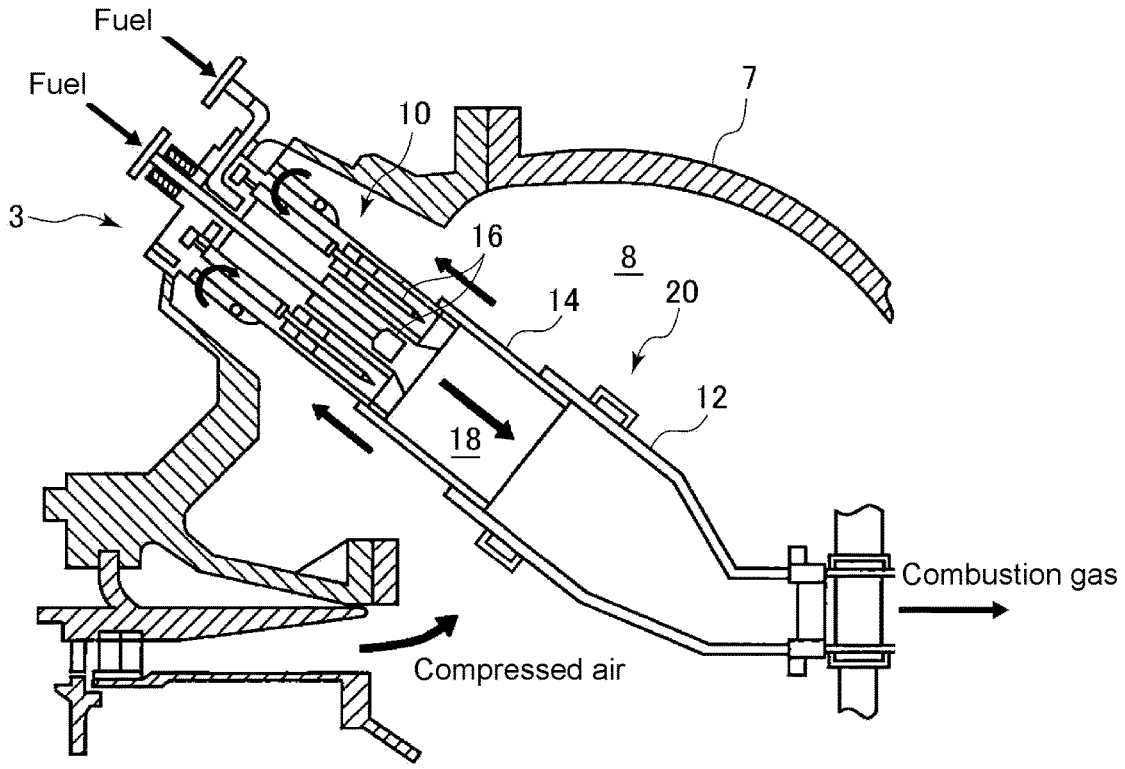
FIG. 2 is a view for describing the configuration of a combustor of the gas turbine according to Embodiment 1 of the present disclosure.

As shown in FIG. 2, in a housing 7, a combustor installation space 8 is disposed. The combustor installation space 8 is located between an outlet of the compressor 2 (see FIG. 1) and an inlet of the turbine 4 (see FIG. 1). The combustor 3 is disposed in the combustor installation space 8, the compressed air flows into the combustor 3 from one end side of the combustor 3, and fuel is supplied from outside.

More specifically, the combustor 3 includes a nozzle portion 10, a swirler support cylinder 14, and a combustion cylinder 12. The swirler support cylinder 14 and the combustion cylinder 12 are connected to each other. The nozzle portion 10 has at least one nozzle 16 for injecting the fuel supplied from outside toward the inside of the swirler support cylinder 14 and the combustion cylinder 12. The combustion nozzle 16 may include, for example, one pilot nozzle, and a plurality of main nozzles disposed concentrically around the pilot nozzle.

The swirler support cylinder 14 and the combustion cylinder 12 each have a cylindrical shape. The nozzle portion 10 is joined to one end side (upstream end side) of the swirler support cylinder 14, and a passage 18 for a combustion gas, which is produced by combusting the fuel injected from the combustion nozzle 16, is defined in the swirler support cylinder 14 and the combustion cylinder 12. The passage 18 is supplied with the compressed air via gaps between the combustion nozzles 16, and the fuel reacts with the compressed air to be combusted, producing the combustion gas.

<Configuration of Combustor Component of Combustor According to Embodiment 1 of Present Disclosure>

Figure 3:
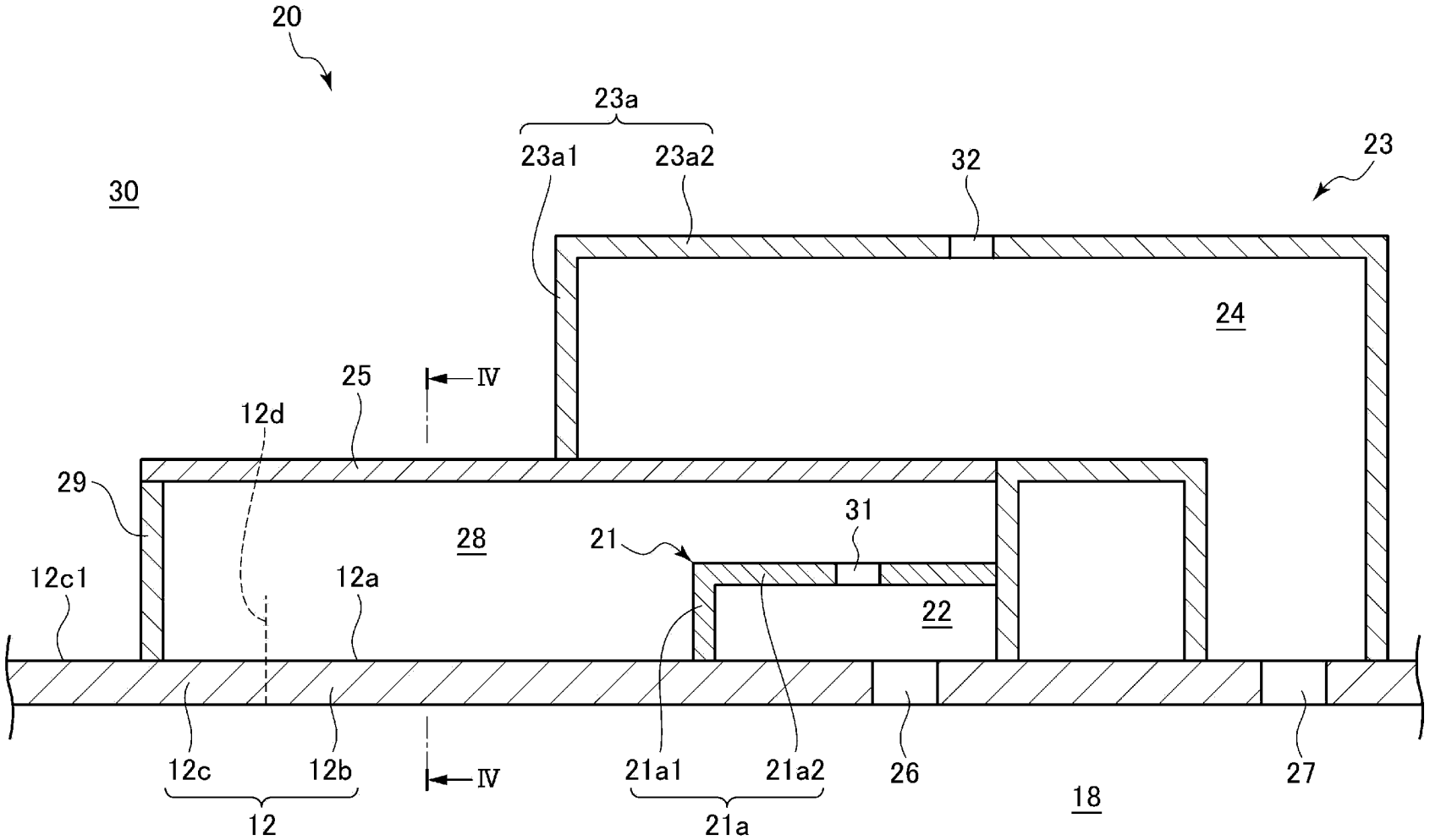
FIG. 3 is a view for describing a combustor component of the combustor of the gas turbine according to Embodiment 1 of the present disclosure.

As shown in FIG. 3, a combustor component 20 includes the above-described combustion cylinder 12, a first acoustic device 21 mounted on the radially outer side of the combustion cylinder 12 so as to cover the combustion cylinder 12, a second acoustic device 23 mounted on the radially outer side of the first acoustic device 21 so as to cover the first acoustic device 21, and a partition wall 25.

The first acoustic device 21 includes a first housing 21*a* having a side wall 21*a*1 and an upper wall 21*a*2, and the first housing 21*a* internally defines a first cavity 22. The second acoustic device 23 includes a second housing 23*a* having a side wall 23*a*1 and an upper wall 23*a*2, and the second housing 23*a* internally defines a second cavity 24. Herein, of the walls respectively forming the first housing 21*a* and the second housing 23*a*, the upper walls 21*a*2 and 23*a*2 are, respectively, walls each having the longest radial distance from the combustion cylinder 12, that is, walls respectively defining radially outer boundaries of the first cavity 22 and the second cavity 24. Further, of the walls respectively forming the first housing 21*a* and the second housing 23*a*, the side walls 21*a*1 and 23*a*1 are, respectively, walls respectively defining outer boundaries of the first cavity 22 and the second cavity 24 in the axial direction of the combustion cylinder 12. The first cavity 22 communicates with the passage 18 via a first through hole 26 formed in the combustion cylinder 12. The second cavity 24 communicates with the passage 18 via a second through hole 27 formed in the combustion cylinder 12.

The partition wall 25 is disposed on the radially outer side of the first acoustic device 21 so as to form a radial gap constituting a partition space 28 with the first acoustic device 21, and separates the partition space 28 from the second cavity 24. The partition wall 25 extends in the axial direction of the combustion cylinder 12 through the radially inside of the second acoustic device 23, and is supported by a support member 29 on an outer surface 12*a* of the combustion cylinder 12. By providing such support member 29, it is possible to support the partition wall 25 by the support member 29 without having a cantilever support structure, making it possible to reliably support the partition wall 25.

Further, in an axial range of the combustion cylinder 12 where at least one of the first acoustic device 21 or the second acoustic device 23 is disposed, if the combustion cylinder 12 has a cylindrical wall 12*b* in which a hollow portion is formed such as an MT fin (internal cooling passage structure), it is preferable that the support member 29 is disposed on an outer surface 12*cl* of a solid cylindrical wall 12*c* outside the range of the cylindrical wall 12*b*. In this case, the partition wall 25 is configured to extend to the support member 29 along the axial direction of the combustion cylinder 12 beyond a boundary 12*d* between the cylindrical wall 12*b* and the cylindrical wall 12*c*. With such configuration, since the support member 29 is disposed on the solid portion (cylindrical wall 12*c*) of the combustion cylinder 12 having excellent strength in the absence of the hollow portion, it is possible to support the partition wall 25 more reliably.

Figure 4:
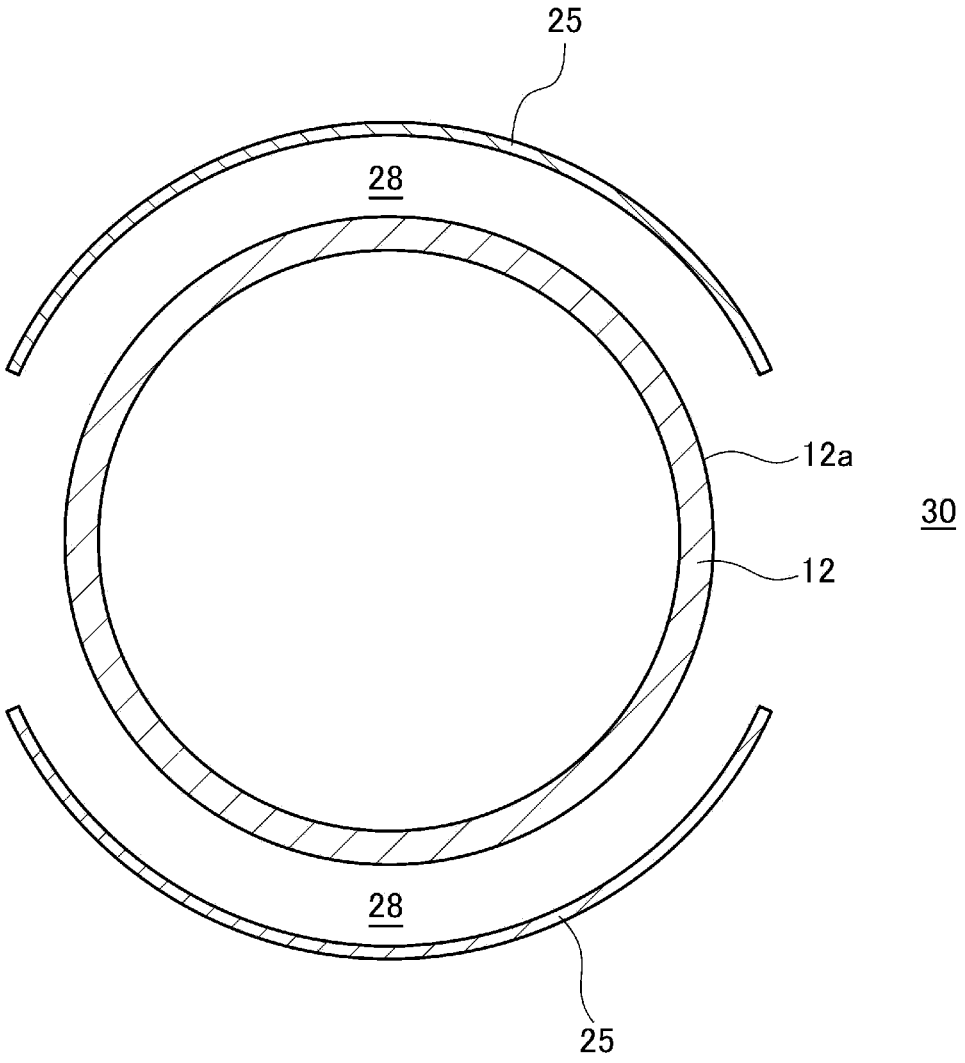
FIG. 4 is a view of cut end surface along line IV-IV of FIG. 3.

As shown in FIG. 4, the partition wall 25 may be an annular wall extending in the circumferential direction along the outer surface 12*a* of the combustion cylinder 12. In this case, it may be configured such that the partition space 28 and an outer space 30 of the combustion cylinder 12 communicate with each other at circumferential one end portion or both end portions of the partition wall 25. It may be configured such that the partition space 28 and the outer space 30 communicate with each other by forming a through hole in the partition wall 25 or the support member 29 (see FIG. 3) in place of or together with the circumferential end portion of the partition wall 25. However, with the configuration of FIG. 4, since the partition space 28 and the outer space 30 can communicate with each other without forming the through hole in the partition wall 25, it is possible to suppress that formation work of the combustor component 20 becomes complicated.

As shown in FIG. 3, in the first housing 21*a* of the first acoustic device 21, a first hole 31 is formed which penetrates the first housing 21*a* so as to cause the partition space 28 and the first cavity 22 to communicate with each other. FIG. 3 is drawn such that only one first hole 31 is formed which is an upper opening formed in the upper wall 21*a*2 of the first housing 21*a*. However, the plurality of first holes 31 may be formed in the first housing 21*a*, or the first hole 31 may be formed in the side wall 21*a*1 or in both of the side wall 21*a*1 and the upper wall 21*a*2.

Since the partition space 28 and the outer space 30 communicate with each other as described above, the first hole 31, which causes the partition space 28 and the first cavity 22 to communicate with each other, constitutes a first communication passage which causes the first cavity 22 and the outer space 30 to communicate with each other via the partition space 28. That is, the first communication passage causes the first cavity 22 and the outer space 30 to communicate with each other without via the first through hole 26 and the second cavity 24. Further, since the first cavity 22 and the second cavity 24 do not communicate with each other on the radially outer side of the combustion cylinder 12, no acoustic coupling between the first acoustic device 21 and the second acoustic device 23 is formed. At least one second hole 32 may be formed in the second housing 23*a* of the second acoustic device 23, as necessary.

<Technical Effect of Combustor Component According to Embodiment 1 of Present Disclosure>

As shown in FIG. 2, the combustion gas is produced by combusting the fuel injected from the combustion nozzle 16 to the passage 18 in the combustion cylinder 12, and at this time, a combustion vibration occurs. The frequency of the generated combustion vibration is not constant, but may change depending on an operating state of the gas turbine 1 (see FIG. 1).

As shown in FIG. 3, since the first acoustic device 21 and the second acoustic device 23 have different radial heights from the combustion cylinder 12, tuning frequencies decided by the respective heights are different. That is, since the first acoustic device 21 and the second acoustic device 23 have the different tuning frequencies, if the frequency of the combustion vibration generated according to the operating state of the gas turbine 1 changes, it is possible to attenuate the combustion vibration at a frequency corresponding to the tuning frequency of the first acoustic device 21 or the second acoustic device 23.

The fuel which was not combusted during the operation of the gas turbine 1 may be discharged from the passage 18 during or after the stop of the gas turbine 1, or the purging air may be introduced to the passage 18 during the operation of the gas turbine 1. In the former case in Embodiment 1, the fuel in the passage 18 flows into the first cavity 22 via the first through hole 26, and then the fuel in the first cavity 22 flows into the partition space 28 via the first hole 31. Since the partition space 28 communicates with the outer space 30, the fuel in the partition space 28 is discharged to the outer space 30. On the other hand, in the latter case, the air in the outer space 30 as the purging air sequentially flows through the partition space 28, the first hole 31, the first cavity 22, and the first through hole 26 and is introduced into the passage 18. Introduction of the purging air to the passage 18 and discharge of the uncombusted fuel are also possible via the second through hole 27, the second cavity 24, and the second hole 32.

As described above, since the first hole 31 is disposed which causes the first cavity 22 and the outer space 30 to communicate with each other without via the first through hole 26 and the second cavity 24, it is possible to cause the first cavity 22 and the outer space 30 to communicate with each other, while suppressing acoustic coupling between the first acoustic device 21 and the second acoustic device 23. As a result, it is possible to discharge fuel from the passage 18 during or after the stop of the gas turbine 1, or to introduce purging air to the passage 18 during the operation of the gas turbine 1.

<Description of Modified Example of Combustor Component of Combustor According to Embodiment 1 of Present Disclosure>

Figure 5:
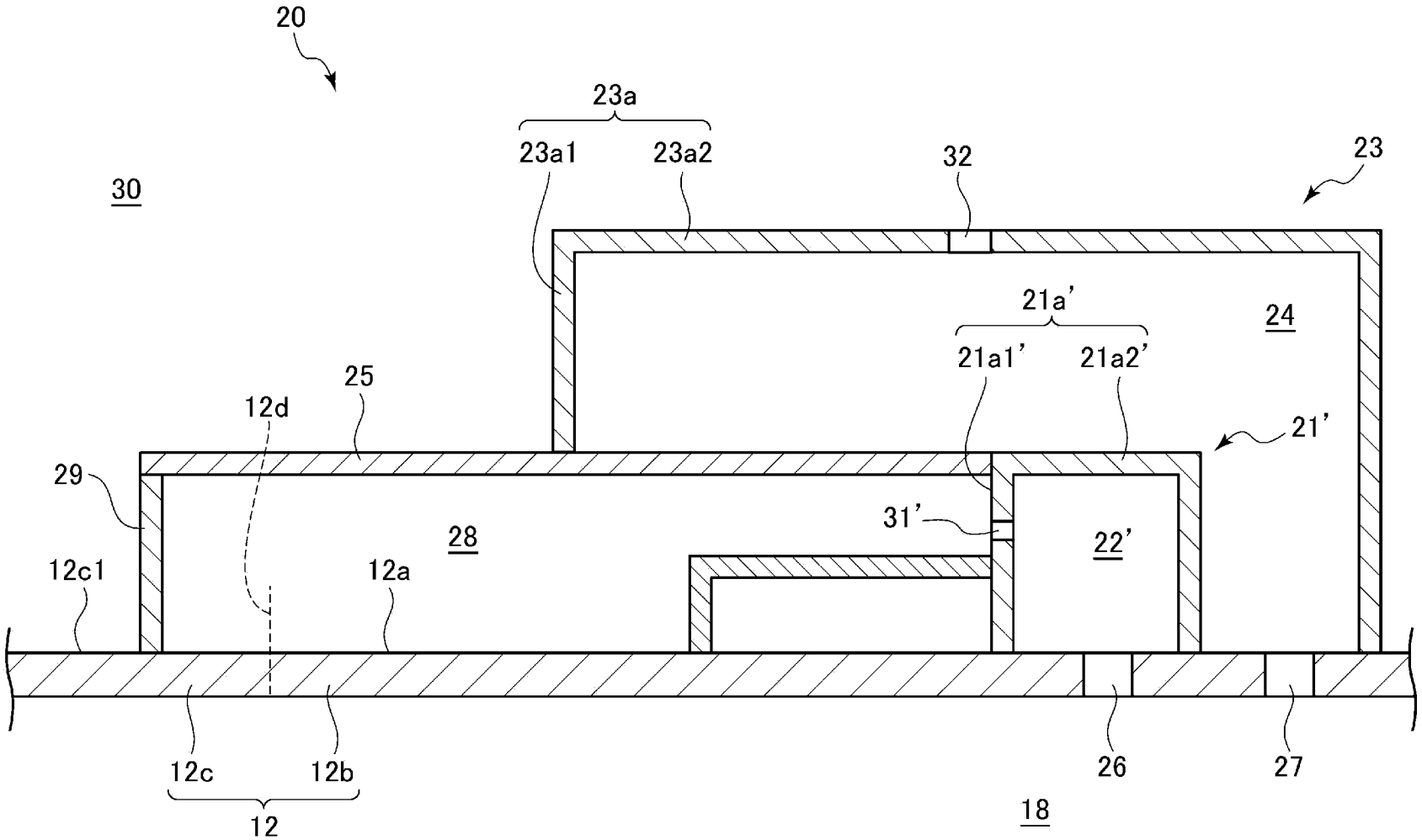
FIG. 5 is a view for describing a modified example of the combustor component of the combustor of the gas turbine according to Embodiment 1 of the present disclosure.

In Embodiment 1, as shown in FIG. 3, a part of the partition space 28 is formed between the first acoustic device 21 and the second acoustic device 23. However, the present disclosure is not limited to this form. As shown in FIG. 5, it may be configured such that the partition wall 25 extends through the radially inner side of the second acoustic device 23 in the axial direction of the combustion cylinder 12 from a side wall 21*a*1' of a first housing 21*a*' of a first acoustic device 21', without a radial gap being formed between the first acoustic device 21' and the second acoustic device 23. In this case, a first hole 31' is formed as a lateral opening disposed in the side wall 21*a*1' of the first housing 21*a*'. In the configuration of such modified example as well, since the first hole 31' is disposed which causes a first cavity 22' and the outer space 30 to communicate with each other without via the first through hole 26 and the second cavity 24, it is possible to cause the first cavity 22' and the outer space 30 to communicate with each other, while suppressing acoustic coupling between the first acoustic device 21' and the second acoustic device 23.

Embodiment 2

Next, the combustor component according to Embodiment 2 will be described. The combustor component according to Embodiment 2 is modified from Embodiment 1 so as to have a three-story configuration. In Embodiment 2, the same constituent elements as those in Embodiment 1 are associated with the same reference characters and not described again in detail. The terms "two-story" and "three-story" in the specification can be paraphrased as "double structure" and "triple structure" or "two-layer structure" and "triple structure", respectively, and what they mean is the same.

<Configuration of Combustor Component of Combustor According to Embodiment 2 of Present Disclosure>

Figure 6:
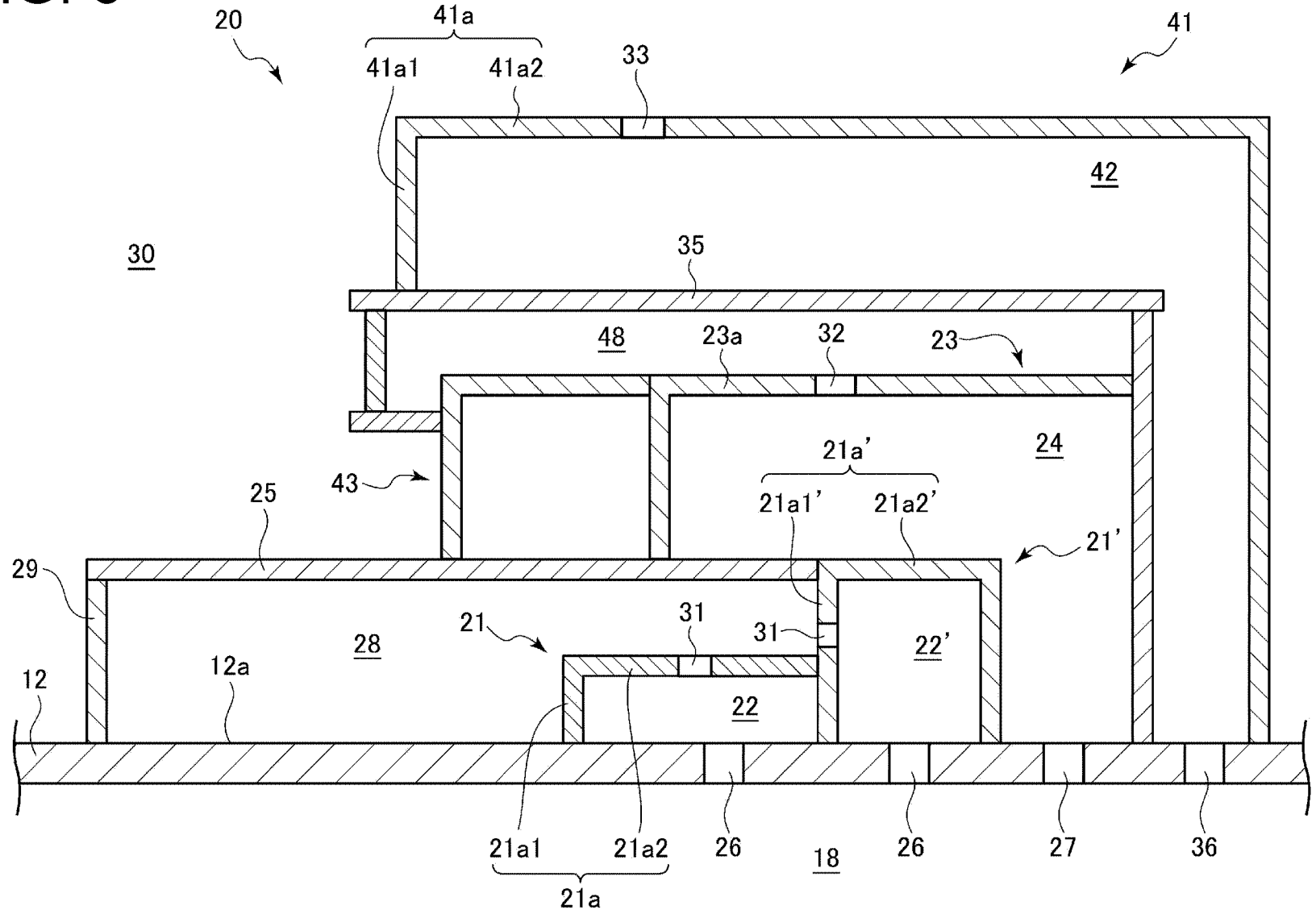
FIG. 6 is a view for describing the combustor component of the combustor of the gas turbine according to Embodiment 2 of the present disclosure.

As shown in FIG. 6, the combustor component 20 according to Embodiment 2 of the present disclosure includes the first acoustic device 21 with the configuration disclosed in FIG. 3 and the first acoustic device 21' with the configuration disclosed in FIG. 5, the second acoustic device 23 with the configuration disclosed in FIGS. 3 and 5, the partition wall 25, and the support member 29, and the partition space 28 with the same configuration as Embodiment 1 is formed between the partition wall 25, and the combustion cylinder 12 and the first acoustic device 21. Since the first acoustic device 21 and the first acoustic device 21' have different radial heights from the combustion cylinder 12, tuning frequencies decided by the respective heights are different. In Embodiment 2, the at least one second hole 32 is formed in the second housing 23*a* of the second acoustic device 23.

The combustor component 20 according to Embodiment 2 further includes a third acoustic device 41. The third acoustic device 41 includes a third housing 41*a* having a side wall 41*a*1 and an upper wall 41*a*2, and the third housing 41*a* internally defines a third cavity 42. The third acoustic device 41 is located on the radially outer side of the second acoustic device 23 so as to cover the second acoustic device 23, and the third cavity 42 communicates with the passage 18 via a third through hole 36 formed in the combustion cylinder 12. Between the second acoustic device 23 and the third acoustic device 41, a radial gap, which constitutes a second partition space 48 communicating with the outer space 30, is formed by the second partition wall 35 disposed so as to extend in the axial direction of the combustion cylinder 12, and the second cavity 24 and the second partition space 48 communicate with each other via the second hole 32.

Since the second partition space 48 and the outer space 30 communicate with each other, the second hole 32, which causes the second partition space 48 and the second cavity 24 to communicate with each other, constitutes a second communication passage which causes the second cavity 24 and the outer space 30 to communicate with each other via the second partition space 48. That is, the second communication passage causes the second cavity 24 and the outer space 30 to communicate with each other without via the second through hole 27 and the third cavity 42. Further, since the first cavity 22 and the second cavity 24, and the third cavity 42 do not communicate with each other on the radially outer side of the combustion cylinder 12, no acoustic coupling among the first acoustic device 21, the second acoustic device 23, and the third acoustic device 41 is formed. At least one third hole 33 may be formed in the third housing 41*a* of the third acoustic device 41, as necessary.

Further, in Embodiment 2, another acoustic device 43 adjacent to the second acoustic device 23 may be disposed between the partition space 28 and the second partition space 48. Other configurations are the same as Embodiment 1.

<Technical Effect of Combustor Component According to Embodiment 2 of Present Disclosure>

If the fuel which was not combusted during the operation of the gas turbine 1 is discharged from the passage 18 during or after the stop of the gas turbine 1, or if the purging air is introduced to the passage 18 during the operation of the gas turbine 1, in Embodiment 1, the communication between the passage 18 and the outer space 30 via the partition space 28, the first hole 31, the first cavity 22, and the first through hole 26 is used. In Embodiment 2, in addition to this form, in the former case, the fuel in the passage 18 flows into the second cavity 24 via the second through hole 27, and then the fuel in the second cavity 23 flows into the second partition space 48 via the second hole 32. Since the second partition space 48 communicates with the outer space 30, the fuel in the second partition space 48 is discharged to the outer space 30. On the other hand, in the latter case, the air in the outer space 30 as the purging air sequentially flows through the second partition space 48, the second hole 32, the second cavity 24, and the second through hole 27 and is introduced into the passage 18.

As described above, even in the acoustic device having the three-story configuration with respect to the radial direction of the combustion cylinder 12, since the second hole 32 is further disposed which causes the second cavity 24 and the outer space 30 to communicate with each other without via the second through hole 27 and the third cavity 42, it is possible to cause the outer space 30 to communicate with each of the first cavity 22 and the second cavity 24, while suppressing acoustic coupling between the third acoustic device 41, and each of the first acoustic device 21 and the second acoustic device 23.

<Description of Modified Example of Combustor Component of Combustor According to Embodiment 2 of Present Disclosure>

In Embodiment 2, the first communication passage may not be disposed which causes the first cavity 22 and the outer space 30 to communicate with each other without via the first through hole 26 and the second cavity 24. Even in this case, since the passage 18 and the outer space 30 communicate with each other via the second partition space 48, the second hole 32, the second cavity 24, and the second through hole 27, it is possible to discharge the fuel, which was not combusted during the operation of the gas turbine 1, from the passage 18 during or after the stop of the gas turbine 1, and to introduce the purging air to the passage 18 during the operation of the gas turbine 1. In the description of the operation in Embodiment 1, the specific operation in this case can read the first cavity 22, the second cavity 24, the partition space 28, the first through hole 26, the second through hole 27, and the first hole 31 as the second cavity 24, the third cavity 42, the second partition space 48, the second through hole 27, the third through hole 36, and the second hole 32, respectively.

Embodiment 3

Next, the combustor component according to Embodiment 3 will be described. The combustor component according to Embodiment 3 is modified from Embodiment 1 in the configuration of the first communication passage. In Embodiment 3, the same constituent elements as those in Embodiment 1 are associated with the same reference characters and not described again in detail.

<Configuration of Combustor Component of Combustor According to Embodiment 3 of Present Disclosure>

Figure 7:
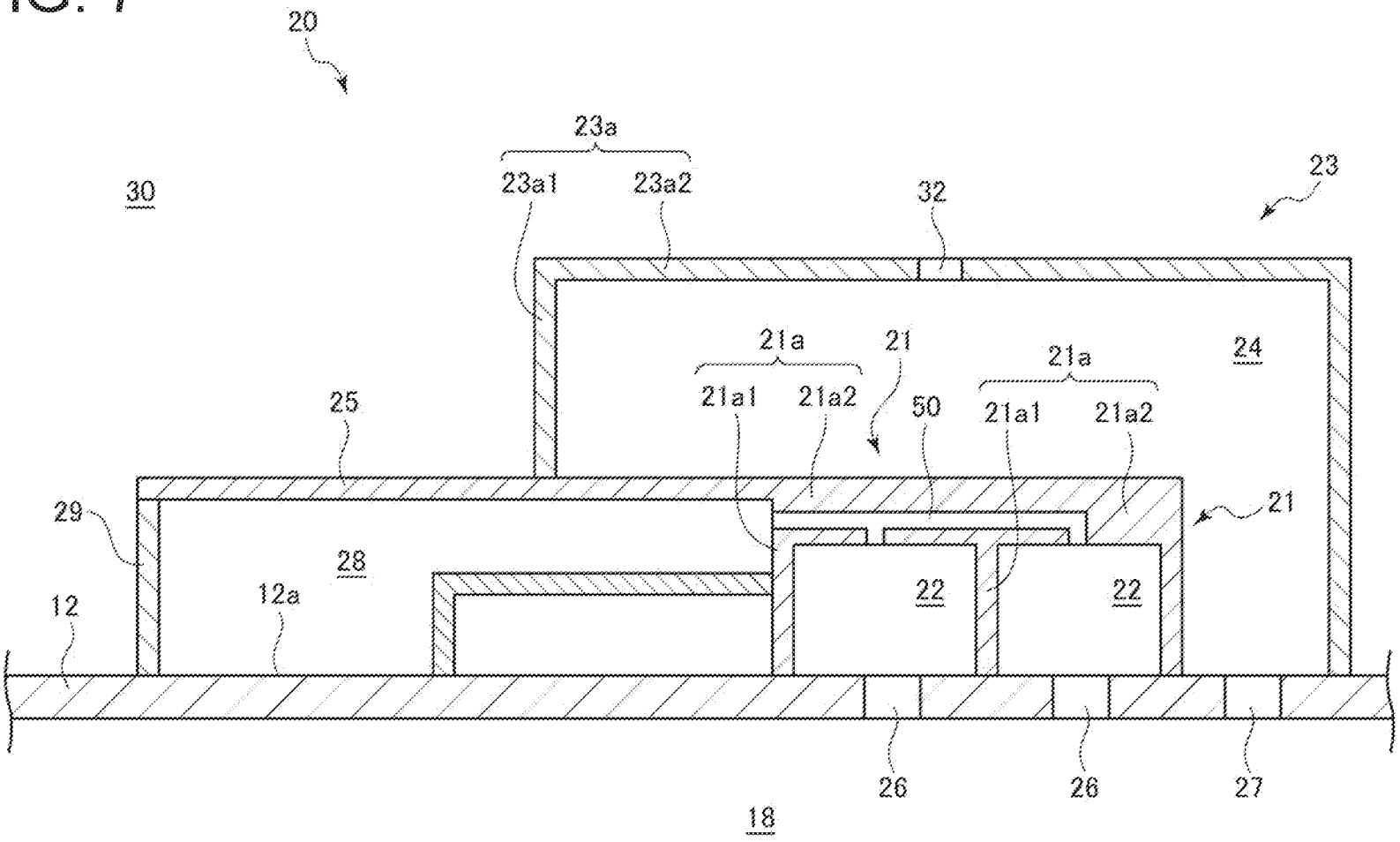
FIG. 7 is a view for describing the combustor component of the combustor of the gas turbine according to Embodiment 3 of the present disclosure.

As shown in FIG. 7, the combustor component 20 according to Embodiment 3 of the present disclosure includes two first acoustic devices 21, 21 having the same radial height from the combustion cylinder 12. The respective first cavities 22, 22 of the two first acoustic devices 21, 21, communicate with the passage 18 via the respective first through holes 26, 26 formed in the combustion cylinder 12. The two first acoustic devices 21, 21 are adjacent to each other, and the partition space 28 is not formed between the two first acoustic devices 21, 21 and the second acoustic device 23, and the partition space 28 is formed so as to extend from the side wall 21*a*1 of the first housing 21*a* of one of the two first acoustic devices 21, 21 to the support member 29 along the axial direction of the combustion cylinder 12. That is, the partition space 28 is formed at a position away from each of the first cavities 22, 22 in the axial direction of the combustion cylinder 12.

Each of the first cavities 22, 22 and the partition space 28 communicate with each other via an internal passage 50 formed in the upper wall 21*a*2 (wall member) of the first housing 21*a* of each of the two first acoustic devices 21, 21. The internal passage 50 is configured to extend in the upper wall 21*a*2 along the axial direction of the combustion cylinder 12. Since the partition space 28 and the outer space 30 communicate with each other, the internal passage 50, which causes the partition space 28 and each of the first cavities 22, 22 to communicate with each other, constitutes the first communication passage which causes each of the first cavities 22, 22 and the outer space 30 to communicate with each other via the partition space 28. In FIG. 7, the two first acoustic devices 21 are disposed so as to be adjacent to each other in the axial direction of the combustion cylinder 12. However, one first acoustic device 21 may be disposed, or not less than three first acoustic devices 21 may be disposed so as to be adjacent to each other in the axial direction of the combustion cylinder 12.

In FIG. 7, if the two first acoustic devices 21, 21 are viewed as the cross-section, the respective first cavities 22 of the two first acoustic devices 21, 21 are drawn to spatially be separated from each other. However, the respective first cavities 22 may be one space by a bent structure. By connecting the respective first cavities 22 of the two or not less than three first acoustic devices 21 to each other, it is possible to provide the two or not less than three first acoustic devices 21 as one first acoustic device 21 having the cavities adjacent in the axial direction.

Figure 8:
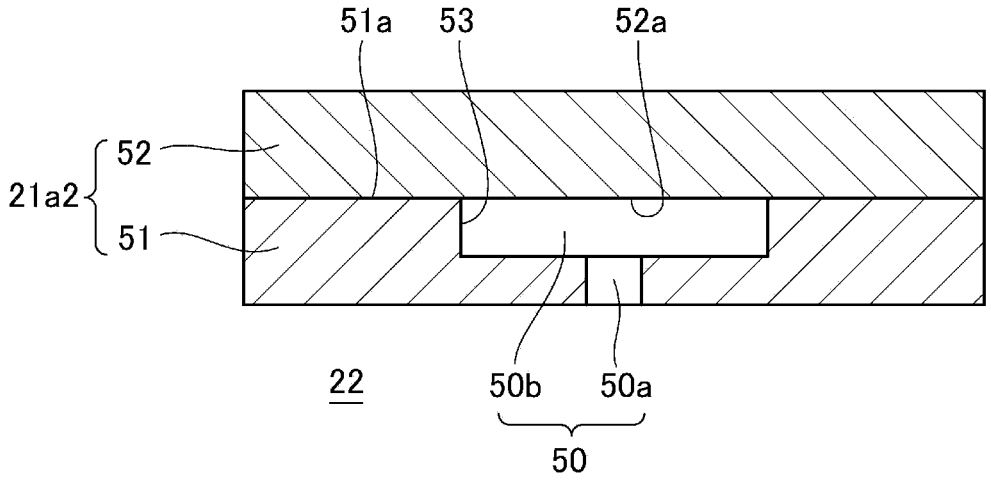
FIG. 8 is a view for describing an example of the configuration of an internal passage formed in the combustor component of the combustor of the gas turbine according to Embodiment 3 of the present disclosure.

FIG. 8 shows an example of the configuration of the internal passage 50. In this example, the upper wall 21*a*2 has a two-layer structure in which a first layer 51 and a second layer 52, which is located on the radially outer side of the combustion cylinder 12 (see FIG. 7) relative to the first layer 51, are bonded to each other. The internal passage 50 is configured to include a radial passage 50*a* which extends in the thickness direction of the first layer 51 and has one end opening to the first cavity 22, and an axial passage 50*b* which communicates with another end of the radial passage 50*a* and extends in a direction perpendicular to the thickness direction of the first layer 51 (or the axial direction of the combustion cylinder 12). The axial passage 50*b* is defined by a groove 53 which is recessed with respect to a surface 51*a* of the first layer 51 bonded to the second layer 52, and a surface 52*a* of the second layer 52 bonded to the first layer 51. FIG. 8 is drawn such that only one radial passage 50*a* is formed. However, not less than two radial passages 50*a* may be formed so as to communicate with the one axial passage 50*b*. Further, the number of axial passage 50*b* is not limited to one, either, but not less than two axial passages 50*b* may be formed.

Figure 9:
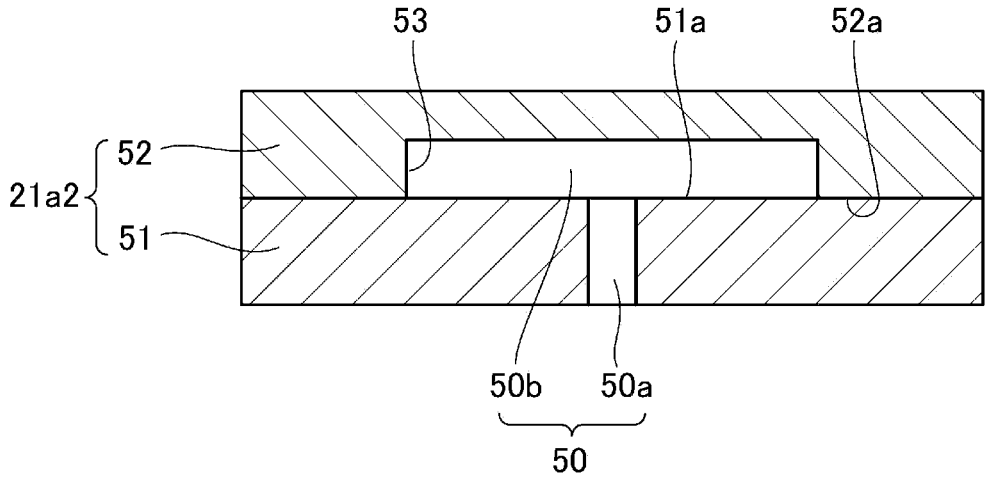
FIG. 9 is a view for describing another example of the configuration of the internal passage formed in the combustor component of the combustor of the gas turbine according to Embodiment 3 of the present disclosure.

FIG. 9 shows another example of the configuration of the internal passage 50. In this example, as in FIG. 8, the upper wall 21*a*2 has the two-layer structure including the first layer 51 and the second layer 52. The internal passage 50 is configured to include the radial passage 50*a* which is formed to penetrate the first layer 51 in the thickness direction, and the axial passage 50*b* which extends in the direction perpendicular to the thickness direction of the second layer 52 (or the axial direction of the combustion cylinder 12). The axial passage 50*b* is defined by the groove 53 which is recessed with respect to the surface 52*a* of the second layer 52, and the surface 51*a* of the first layer 51. FIG. 9 is drawn such that only one radial passage 50*a* is formed. However, not less than two radial passages 50*a* may be formed so as to communicate with the one axial passage 50*b*. Further, the number of axial passage 50*b* is not limited to one, either, but not less than two axial passages 50*b* may be formed.

Figure 10:
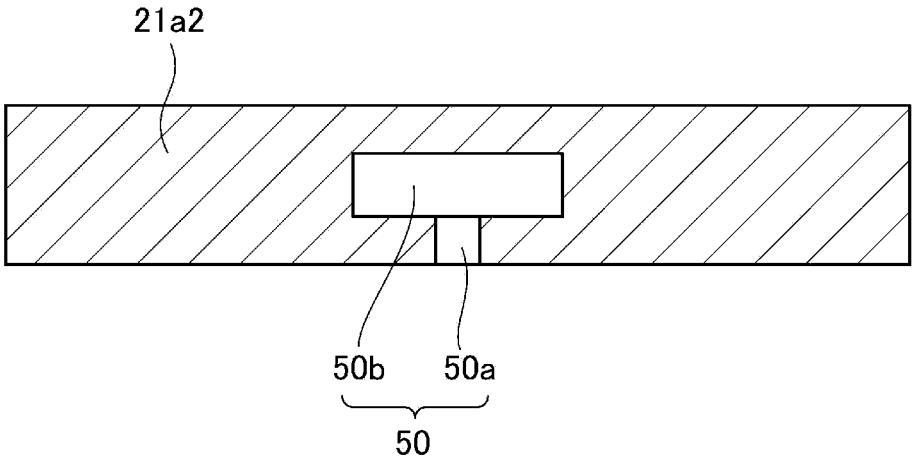
FIG. 10 is a view for describing still another example of the configuration of the internal passage formed in the combustor component of the combustor of the gas turbine according to Embodiment 3 of the present disclosure.

FIG. 10 shows still another example of the configuration of the internal passage 50. In this example, the upper wall 21*a*2 has the one-layer structure, and the internal passage 50 is configured to include the radial passage 50*a* which extends in the thickness direction of the upper wall 21*a*2 and has the one end opening to the first cavity 22, and the axial passage 50*b* which communicates with the another end of the radial passage 50*a* and extends in the direction perpendicular to the thickness direction of the upper wall 21*a*2 (or the axial direction of the combustion cylinder 12). FIG. 10 is drawn such that only one internal passage 50 is formed. However, not less than two internal passages 50 may be formed.

<Technical Effect of Combustor Component According to Embodiment 3 of Present Disclosure>

In the configuration of Embodiment 3 shown in FIG. 7 as well, since the internal passage 50 is disposed which causes the two first cavities 22, 22 and the outer space 30 to communicate with each other without via the first through hole 26 and the second cavity 24, it is possible to cause the two first cavities 22, 22 and the outer space 30 to communicate with each other, while suppressing acoustic coupling between the first acoustic device 21 and the second acoustic device 23.

<Description of Modified Example of Combustor Component of Combustor According to Embodiment 3 of Present Disclosure>

Figure 11:
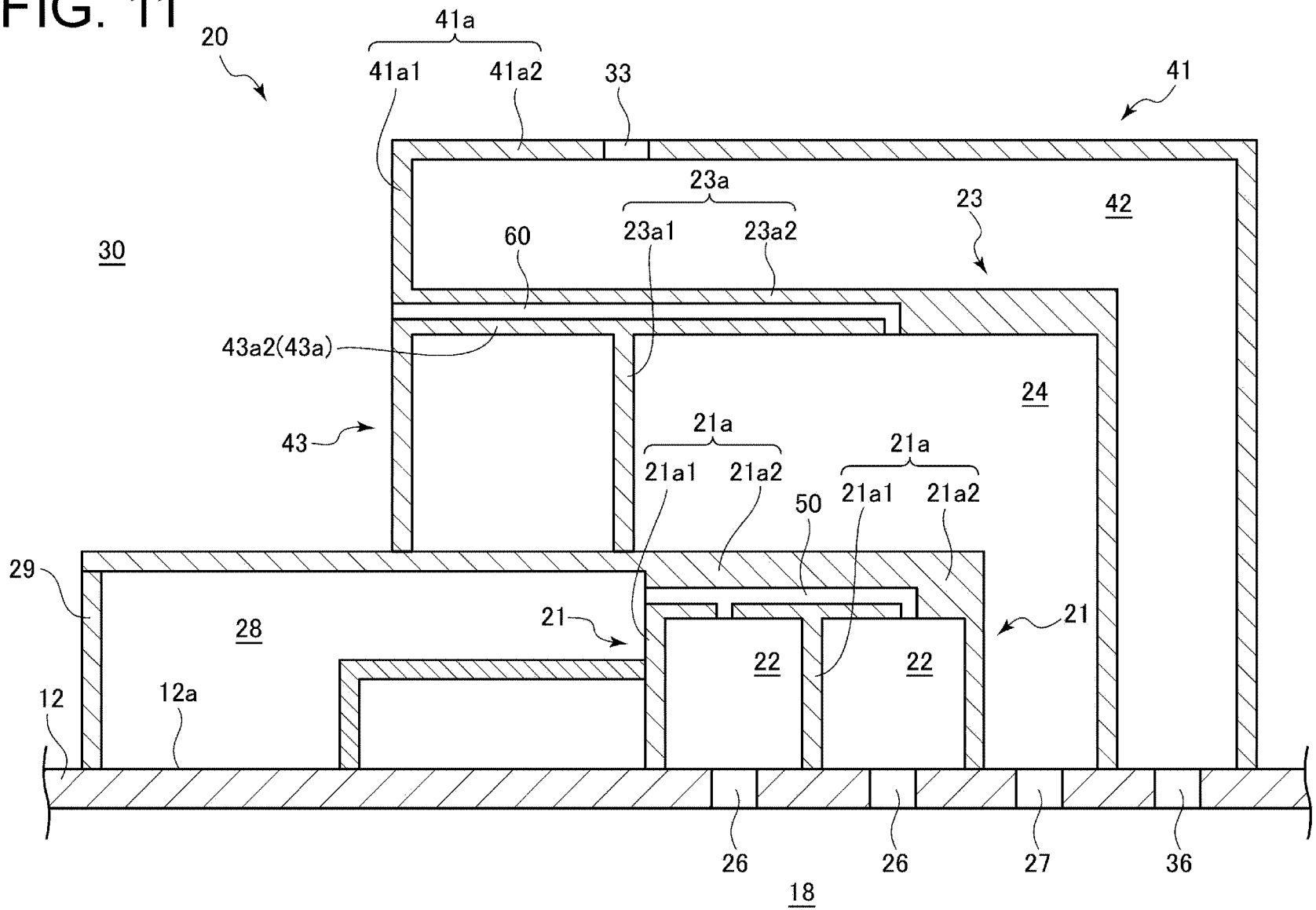
FIG. 11 is a view for describing a modified example of the combustor component of the combustor of the gas turbine according to Embodiment 3 of the present disclosure.

As shown in FIG. 11, relative to the configuration shown in FIG. 10, the modified example of the combustor component 20 according to Embodiment 3 of the present disclosure further includes the third acoustic device 41 located on the radially outer side of the second acoustic device 23 so as to cover the second acoustic device 23, and the another acoustic device 43 adjacent to the second acoustic device 23 between the partition space 28 and the third acoustic device 41. No radial gap is formed between the another acoustic device 43, and the third acoustic device 41 and the second acoustic device 23, and the another acoustic device 43, and the third acoustic device 41 and the second acoustic device 23 are divided by the upper wall 23*a*2 of the second housing 23*a* of the second acoustic device 23 and the upper wall 43*a*2 of the housing 43*a* of the another acoustic device 43.

The second cavity 24 and the outer space 30 communicate with each other via an internal passage 60 formed in the upper wall 23*a*2 and the upper wall 43*a*2. The internal passage 60 is configured to extend in the upper wall 21*a*2 along the axial direction of the combustion cylinder 12. In this modified example, the internal passage 60 constitutes the second communication passage causing the second cavity 24 and the outer space 30 to communicate with each other.

In this modified example, even in the acoustic device having the three-story configuration with respect to the radial direction of the combustion cylinder 12, since the internal passage 60 is further disposed which causes the second cavity 24 and the outer space 30 to communicate with each other without via the second through hole 27 and the third cavity 42, it is possible to cause the outer space 30 to communicate with each of the first cavity 22 and the second cavity 24, while suppressing acoustic coupling between the third acoustic device 41, and each of the first acoustic device 21 and the second acoustic device 23.

Embodiment 4

Next, the combustor component according to Embodiment 4 will be described. The combustor component according to Embodiment 4 is modified from Embodiment 1 so as not to include the partition wall 25. In Embodiment 4, the same constituent elements as those in Embodiment 1 are associated with the same reference characters and not described again in detail.

<Configuration of Combustor Component of Combustor According to Embodiment 4 of Present Disclosure>

Figure 12:
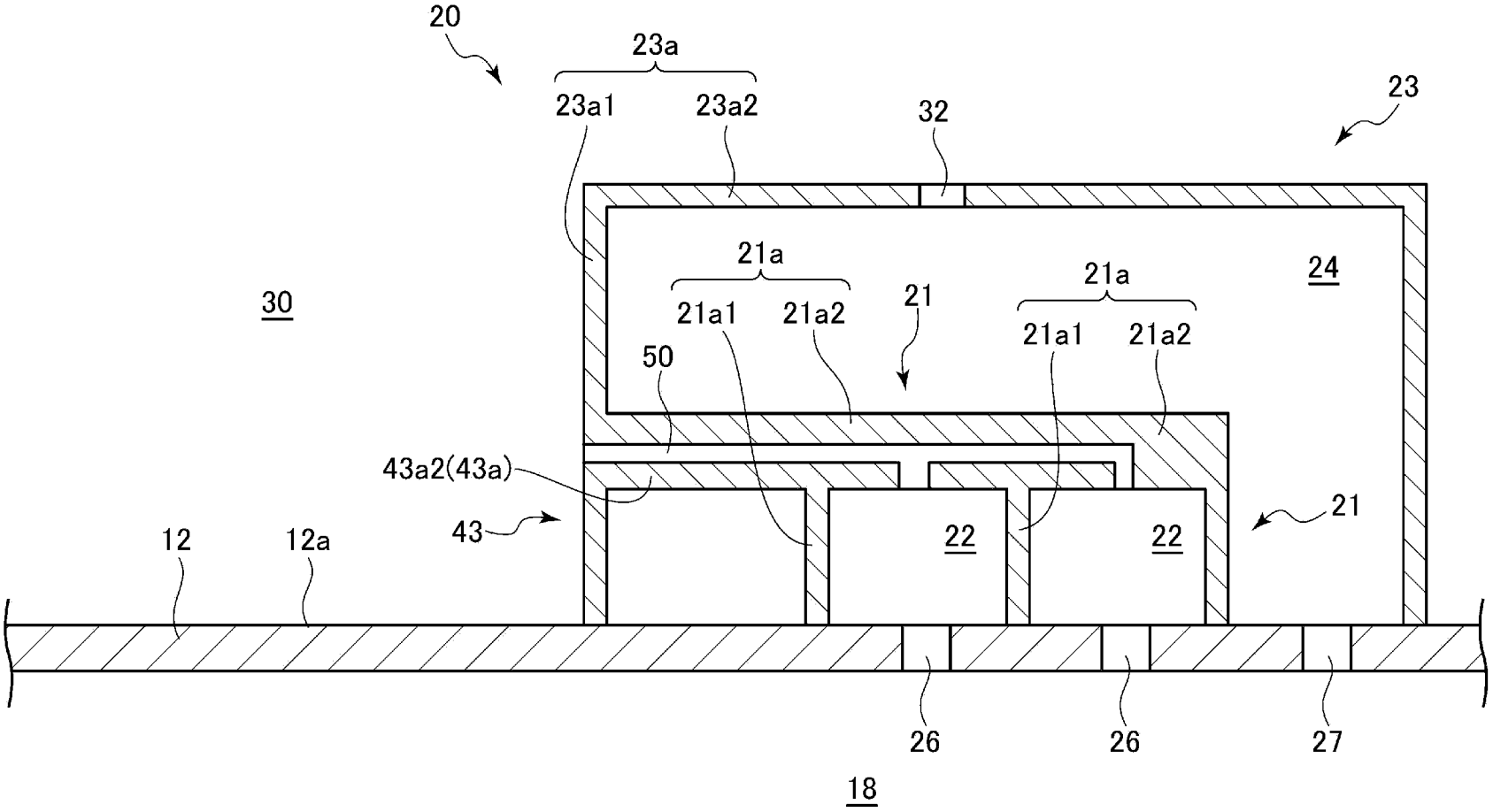
FIG. 12 is a view for describing the combustor component of the combustor of the gas turbine according to Embodiment 4 of the present disclosure.

As shown in FIG. 12, the combustor component 20 according to Embodiment 4 of the present disclosure includes the two first acoustic devices 21, 21 and the another acoustic device 43 mounted on the radially outer side of the combustion cylinder 12 so as to cover the combustion cylinder 12, and the second acoustic device 23 mounted on the radially outer side of these acoustic devices so as to cover these acoustic devices. The two first acoustic devices 21, 21 and the another acoustic device 43 have the same radial height from the combustion cylinder 12.

Each of the first cavities 22, 22 and the outer space 30 communicate with each other via the internal passage 50 formed in the upper wall 21*a*2 of the first housing 21*a* of each of the two first acoustic devices 21, 21 and the upper wall 43*a*2 (wall member) of the housing 43*a* of the another acoustic device 43. The internal passage 50 extends in the upper wall 21*a*2 and the upper wall 43*a*2 along the axial direction of the combustion cylinder 12, passes through the radially outer side of the another acoustic device 43 located between the combustion cylinder 12 and the second cavity 24 of the second acoustic device 23 in the radial direction, and opens to the outer space 30 opposite to the two first acoustic devices 21, 21 across the another acoustic device 43. The internal passage 50 constitutes the first communication passage causing the outer space 30 to communicate with each of the two first cavities 22, 22. In FIG. 12, the two first acoustic devices 21 and the another acoustic device 43 are disposed. However, the number of each can optionally be changed. The respective first cavities 22, 22 of the two first acoustic devices 21 may spatially be connected such that the two first acoustic devices 21 are established as one acoustic device.

<Technical Effect of Combustor Component According to Embodiment 4 of Present Disclosure>

In the configuration of Embodiment 4 shown in FIG. 12 as well, since the internal passage 50 is disposed which causes the two first cavities 22, 22 and the outer space 30 to communicate with each other without via the first through hole 26 and the second cavity 24, it is possible to cause the two first cavities 22, 22 and the outer space 30 to communicate with each other, while suppressing acoustic coupling between the first acoustic device 21 and the second acoustic device 23. Further, by causing the first communication passage to serve as the internal passage 50 disposed in the wall member including at least the first housing 21*a*, it is possible to make the partition wall 25 (see FIG. 3 or the like) unnecessary. Thus, it is possible to downsize the overall configuration of the combustor component 20.

The contents described in the above embodiments would be understood as follows, for instance.

[1] A combustor component according to one aspect is a combustor component (20) of a combustor (3) for combusting fuel to produce a combustion gas, that includes a combustion cylinder (12) forming a passage (18) for the combustion gas, a first acoustic device (21) which internally includes a first cavity (22) communicating with the passage (18) via a first through hole (26) formed in the combustion cylinder (12), a second acoustic device (23) which is located on a radially outer side of the first acoustic device (21) so as to cover the first acoustic device (21), and internally includes a second cavity (24) communicating with the passage (18) via a second through hole (27) formed in the combustion cylinder (12), and a first communication passage (first hole 31/internal passage 50) causing the first cavity (22) and an outer space (30) of the combustion cylinder (12) to communicate with each other without via the first through hole (26) and the second cavity (24).

With the combustor component of the present disclosure, since the first communication passage is disposed which causes the first cavity and the outer space of the combustion cylinder to communicate with each other without via the first through hole and the second cavity, it is possible to cause the first cavity of the first acoustic device and the outer space of the combustion cylinder to communicate with each other, while suppressing acoustic coupling between the first acoustic device and the second acoustic device.

[2] A combustor component according to another aspect is the combustor component defined in [1], that includes a partition wall (25) separating the second cavity (24) from a partition space (28) on a radially inner side of the second cavity (24). The first communication passage (first hole 31/internal passage 50) causes the first cavity (22) and the outer space (30) of the combustion cylinder (12) to communicate with each other via the partition space (28).

With the above configuration, if the first communication passage is formed so as to cause the first cavity and the partition space to communicate with each other, it is possible to cause the first cavity and the outer space of the combustion cylinder to communicate with each other without via the first through hole and the second cavity. Thus, it is possible to simplify formation work of the first communication passage.

[3] A combustor component according to still another aspect is the combustor component defined in [2], the first acoustic device (21) includes a first housing (21*a*) defining the first cavity (22), and the first communication passage includes a first hole (31) penetrating the first housing (21*a*) so as to cause the partition space (28) and the first cavity (22) to communicate with each other.

With the above configuration, since the first communication passage can be the first hole penetrating the first housing so as to cause the partition space and the first cavity to communicate with each other, it is possible to simplify the formation work of the first communication passage.

[4] A combustor component according to yet another aspect is the combustor component defined in [3], the partition wall (25) is disposed on the radially outer side of the first acoustic device (21) so as to form a radial gap constituting the partition space (28) between the partition wall (25) and the first acoustic device (21), and the first hole (31) includes an upper opening disposed in an upper wall (21*a*2) of the first housing (21*a*).

With the above configuration, since the first communication passage can be the upper opening disposed in the upper wall of the first housing, it is possible to simplify the formation work of the first communication passage.

[5] A combustor component according to yet another aspect is the combustor component defined in [3], the partition wall (25) extends through a radially inner side of the second acoustic device (23) from a side wall (21*a*1) of the first housing (21*a*) of the first acoustic device (21) in an axial direction of the combustion cylinder (12), and the first hole (31) includes a lateral opening disposed in the side wall (21*a*1) of the first housing (21*a*).

With the above configuration, since the first communication passage can be the lateral opening disposed in the side wall of the partition wall of the first housing, it is possible to simplify the formation work of the first communication passage.

[6] A combustor component according to yet another aspect is the combustor component defined in any one of [2] to [5], that includes a support member (29) for supporting the partition wall (25) on an outer surface (12*a*) of the combustion cylinder (12). The partition wall (25) extends to the support member (29) through a radially inner side of the second acoustic device (23) along an axial direction of the combustion cylinder (12).

With the above configuration, it is possible to support the partition wall, which extends through the radially inner side of the second acoustic device in the axial direction, by the support member without having a cantilever support structure. Thus, it is possible to reliably support the partition wall.

[7] A combustor component according to yet another aspect is the combustor component defined in [6], the combustion cylinder (12) includes a cylindrical wall (12*b*) where a hollow portion is formed in an axial range in which at least one of the first acoustic device (21) or the second acoustic device (23) is disposed, the support member (29) is disposed on the outer surface (12*c*1) of the combustion cylinder (cylindrical wall 12*c*) outside the axial range in which the hollow portion is formed, and the partition wall (25) extends to the support member (29) along the axial direction beyond a boundary (12*d*) of the axial range in which the hollow portion is formed.

With such configuration, since the support member is disposed on the solid portion of the combustion cylinder having excellent strength in the absence of the hollow portion, it is possible to support the partition wall more reliably.

[8] A combustor component according to yet another aspect is the combustor component defined in any one of [2] to [7], the partition wall (25) includes an annular wall extending in a circumferential direction along an outer surface (12*a*) of the combustion cylinder (12), and the partition space (28) communicates with the outer space (30) of the combustion cylinder (12) in at least one end portion of the annular wall in the circumferential direction.

With the configuration, since the partition space and the outer space can communicate with each other without forming the through hole in the partition wall, it is possible to suppress that formation work of the combustor component becomes complicated.

[9] A combustor component according to yet another aspect is the combustor component defined in any one of [1] to [8], the first acoustic device (21) includes a first housing (21*a*) defining the first cavity (22), and the first communication passage includes an internal passage (50) which is disposed in a wall member including at least the first housing (21*a*).

With the above configuration, by causing the first communication passage to serve as the internal passage disposed in the wall member including at least the first housing, it is possible to make the partition wall unnecessary. Thus, it is possible to downsize the overall configuration of the combustor component.

[10] A combustor component according to yet another aspect is the combustor component defined in [9], that includes a partition wall (25) separating the second cavity (24) from a partition space (28) on a radially inner side of the second cavity (24). The internal passage (50) extends along an axial direction of the combustion cylinder (12), and opens to the partition space (28) located at a position away from the first cavity (22) in the axial direction.

With the above configuration, even if the partition wall is provided in the above configuration [9], the internal passage can cause the first cavity and the outer space of the combustion cylinder to communicate with each other via the partition space.

[11] A combustor component according to yet another aspect is the combustor component defined in [9], the internal passage (50) extends along an axial direction of the combustion cylinder (12), passes through a radially outer side of another acoustic device (43) located between the combustion cylinder (12) and the second cavity (24) in a radial direction, and opens to the outer space (30) opposite to the first acoustic device (21) across the another acoustic device (43).

With the above configuration, if the partition wall is not provided, the internal passage can cause the first cavity and the outer space of the combustion cylinder to directly communicate with each other. Thus, it is possible to downsize the overall configuration of the combustor component, and even if the partition wall is provided, the internal passage can cause the first cavity and the outer space of the combustion cylinder to communicate with each other via the partition space.

[12] A combustor component according to yet another aspect is the combustor component defined in any one of [1] to [11], that includes a third acoustic device (41) which is located on a radially outer side of the second acoustic device (23) so as to cover the second acoustic device (23), and internally includes a third cavity (42) communicating with the passage (18) via a third through hole (36) formed in the combustion cylinder (12), and a second communication passage (second hole 32/internal passage 60) causing the second cavity (24) and the outer space (30) of the combustion cylinder (12) to communicate with each other without via the second through hole (27) and the third cavity (42).

With the above configuration, even in the acoustic device having the three-story configuration with respect to the radial direction of the combustion cylinder, since the second communication passage is further disposed which causes the second cavity and the outer space to communicate with each other without via the second through hole and the third cavity, it is possible to cause the outer space to communicate with each of the first cavity and the second cavity, while suppressing acoustic coupling between the third acoustic device, and each of the first acoustic device and the second acoustic device.

[13] A combustor according to one aspect includes the combustor component (20) defined in any one of [1] to [12], and a fuel nozzle (16) for injecting the fuel.

With the combustor of the present disclosure, since the first communication passage is disposed which causes the first cavity and the outer space of the combustion cylinder to communicate with each other without via the first through hole and the second cavity, it is possible to cause the first cavity of the first acoustic device and the outer space of the combustion cylinder to communicate with each other, while suppressing acoustic coupling between the first acoustic device and the second acoustic device.

[14] A gas turbine according to one aspect includes the combustor (3) defined in [13], and a turbine (4) which is driven by the combustion gas produced by the combustor (3).

With the gas turbine of the present disclosure, since the first communication passage is disposed which causes the first cavity and the outer space of the combustion cylinder to communicate with each other without via the first through hole and the second cavity, it is possible to cause the first cavity of the first acoustic device and the outer space of the combustion cylinder to communicate with each other, while suppressing acoustic coupling between the first acoustic device and the second acoustic device.

Reference Signs List

1 Gas turbine
3 Combustor
4 Turbine
12 Combustion cylinder
12*a* Outer surface (of combustion cylinder)
12*b* Cylindrical wall (where hollow portion is formed)
12*c* Cylindrical wall (outside axial range where hollow portion is formed)
12*cl* Outer surface (of cylindrical wall 12*c*)
12*d* Boundary
16 Combustion nozzle
20 Combustor component
21 First acoustic device

21*a* First housing
21*a*1 Side wall
21*a*2 Upper wall
22 First cavity
23 Second acoustic device
24 Second cavity
25 Partition wall
26 First through hole
27 Second through hole
28 Partition space
29 Support member
30 Outer space
31 First hole (first communication passage)
32 Second hole (second communication passage)
36 Third through hole
41 Third acoustic device
42 Third cavity
43 Another acoustic device
50 Internal passage (first communication passage)
60 Internal passage (second communication passage)

The invention claimed is:

1. A combustor component of a combustor for combusting fuel to produce a combustion gas, comprising:

a combustion cylinder forming a passage for the combustion gas;

a first acoustic device which internally includes a first cavity communicating with the passage via a first through hole formed in the combustion cylinder;

a second acoustic device which is located on a radially outer side of the first acoustic device so as to cover the first acoustic device, and internally includes a second cavity communicating with the passage via a second through hole formed in the combustion cylinder;

a first communication passage causing the first cavity and an outer space, which is a space outside of the combustion cylinder and the combustor component, to communicate with each other without via the first through hole and the second cavity; and a partition wall separating the second cavity from a partition space on a radially inner side of the second cavity, wherein the first communication passage causes the first cavity and the outer space of the combustion cylinder to communicate with each other via the partition space.

2. The combustor component according to claim 1, wherein the first acoustic device includes a first housing defining the first cavity, and wherein the first communication passage includes a first hole penetrating the first housing so as to cause the partition space and the first cavity to communicate with each other.

3. The combustor component according to claim 2, wherein the partition wall is disposed on the radially outer side of the first acoustic device so as to form a radial gap constituting the partition space between the partition wall and the first acoustic device, and wherein the first hole includes an upper opening disposed in an upper wall of the first housing.

4. The combustor component according to claim 2, wherein the partition wall extends through a radially inner side of the second acoustic device from a side wall of the first housing of the first acoustic device in an axial direction of the combustion cylinder, and wherein the first hole includes a lateral opening disposed in the side wall of the first housing.

5. The combustor component according to claim 1, further comprising a support member for supporting the partition wall on an outer surface of the combustion cylinder, wherein the partition wall extends to the support member through a radially inner side of the second acoustic device along an axial direction of the combustion cylinder.

6. The combustor component according to claim 5, wherein the combustion cylinder includes a cylindrical wall where a hollow portion is formed in an axial range in which at least one of the first acoustic device or the second acoustic device is disposed, wherein the support member is disposed on the outer surface of the combustion cylinder outside the axial range in which the hollow portion is formed, and wherein the partition wall extends to the support member along the axial direction beyond a boundary of the axial range in which the hollow portion is formed.

7. The combustor component according to claim 1, wherein the partition wall includes an annular wall extending in a circumferential direction along an outer surface of the combustion cylinder, and wherein the partition space communicates with the outer space of the combustion cylinder in at least one end portion of the annular wall in the circumferential direction.

8. The combustor component according to claim 1, wherein the first acoustic device includes a first housing defining the first cavity, and wherein the first communication passage includes an internal passage which is disposed in a wall member including at least the first housing.

9. The combustor component according to claim 8, further comprising a partition wall separating the second cavity from a partition space on a radially inner side of the second cavity, wherein the internal passage extends along an axial direction of the combustion cylinder, and opens to the partition space located at a position away from the first cavity in the axial direction.

10. A combustor, comprising:

the combustor component according to claim 1; and a fuel nozzle for injecting the fuel.

11. A gas turbine, comprising:

the combustor according to claim 10; and a turbine which is driven by the combustion gas produced by the combustor.

12. A component of a combustor for combusting fuel to produce a combustion gas, comprising:

a combustion cylinder forming a passage for the combustion gas;

a first acoustic device which internally includes a first cavity communicating with the passage via a first through hole formed in the combustion cylinder;

a second acoustic device which is located on a radially outer side of the first acoustic device so as to cover the first acoustic device, and internally includes a second cavity communicating with the passage via a second through hole formed in the combustion cylinder; and a first communication passage causing the first cavity and an outer space, which is a space outside of the combustion cylinder and the combustor component, to communicate with each other without via the first through hole and the second cavity, wherein the first acoustic device includes a first housing defining the first cavity, wherein the first communication passage includes an internal passage which is disposed in a wall member including at least the first housing, and wherein the internal passage extends along an axial direction of the combustion cylinder, passes through a radially outer side of another acoustic device located between the combustion cylinder and the second cavity in a radial direction, and opens to the outer space opposite to the first acoustic device across the another acoustic device.

13. A combustor component of a combustor for combusting fuel to produce a combustion gas, comprising:

a combustion cylinder forming a passage for the combustion gas;

a first acoustic device which internally includes a first cavity communicating with the passage via a first through hole formed in the combustion cylinder;

a second acoustic device which is located on a radially outer side of the first acoustic device so as to cover the first acoustic device, and internally includes a second cavity communicating with the passage via a second through hole formed in the combustion cylinder;

a first communication passage causing the first cavity and an outer space, which is a space outside of the combustion cylinder and the combustor component, to communicate with each other without via the first through hole and the second cavity;

a third acoustic device which is located on a radially outer side of the second acoustic device so as to cover the second acoustic device, and internally includes a third cavity communicating with the passage via a third through hole formed in the combustion cylinder; and a second communication passage causing the second cavity and the outer space of the combustion cylinder to communicate with each other without via the second through hole and the third cavity.

* * * * *